US007097548B2

(12) United States Patent
Krondorfer et al.

(10) Patent No.: US 7,097,548 B2
(45) Date of Patent: Aug. 29, 2006

(54) UTILITY TOOL WITH ROTATINGLY DRIVEABLE, DISK-SHAPED HUB

(75) Inventors: Harald Krondorfer, Ludwigsburg (DE); Markus Heckmann, Filderstadt (DE); Joachim Schadow, Dettenhausen (DE); Christof Hoelzl, Schwaz (AT); Johann Huber, Kramsach (AT); Wilhelm Schulze, Vomp (AT)

(73) Assignees: Robert Bosch GmbH, Stuttgart (DE); Tyrolit Schleifmittel Swarovski K.G., Schwaz (AT)

( * ) Notice: Subject to any disclaimer, the term of this patent is extended or adjusted under 35 U.S.C. 154(b) by 0 days.

(21) Appl. No.: 10/257,181

(22) PCT Filed: Dec. 14, 2001

(86) PCT No.: PCT/DE01/04757

§ 371 (c)(1),
(2), (4) Date: Mar. 19, 2003

(87) PCT Pub. No.: WO02/070205

PCT Pub. Date: Sep. 12, 2002

(65) Prior Publication Data

US 2003/0162487 A1 Aug. 28, 2003

(30) Foreign Application Priority Data

Feb. 15, 2001 (DE) ..... 101 06 980

(51) Int. Cl.
*B24B 23/02* (2006.01)

(52) U.S. Cl. ..... 451/359; 125/15

(58) Field of Classification Search ..... 451/541, 451/359, 544, 548, 442, 360; 125/15, 13.01
See application file for complete search history.

(56) References Cited

U.S. PATENT DOCUMENTS

| | | | | |
|---|---|---|---|---|
| 2,652,321 | A | 10/1953 | Douglas | |
| 3,526,999 | A | 9/1970 | Jaegers | |
| 3,667,169 | A | 6/1972 | MacKay | |
| 4,251,955 | A | 2/1981 | Shawke | |
| 4,860,721 | A * | 8/1989 | Matsuda | 125/15 |
| 4,962,748 | A * | 10/1990 | Schweickhardt | 125/13.01 |
| 5,839,423 | A * | 11/1998 | Jones et al. | 125/15 |
| 6,129,077 | A * | 10/2000 | Parini | 125/15 |
| 6,136,143 | A | 10/2000 | Lund et al. | |
| 6,408,838 | B1 * | 6/2002 | Ogata et al. | 125/15 |

FOREIGN PATENT DOCUMENTS

| | | |
|---|---|---|
| CH | 577 365 A | 7/1976 |
| DE | 37 28 233 A1 | 3/1989 |
| DE | 44 30 229 A | 2/1996 |
| DE | 298 06 114 U1 | 7/1998 |

* cited by examiner

*Primary Examiner*—Robert A. Rose
(74) *Attorney, Agent, or Firm*—Michael J. Striker

(57) ABSTRACT

The invention is based on an insertable tool with a rotationally driven disk-shaped hub (10, 12), to which a grinding means (14) is secured in the radially outer region.

It is proposed that the hub (10, 12) is embodied with a flexural strength that varies in the radial direction.

14 Claims, 2 Drawing Sheets

UTILITY TOOL WITH ROTATINGLY DRIVEABLE, DISK-SHAPED HUB

BACKGROUND OF THE INVENTION

The invention is based on an insertable tool with a rotationally driven disk-shaped hub.

Typically, disk-shaped insertable tools, such as grinding wheels or cutting-off wheels for angle grinders, consist entirely of bonded grinding means, and they have a central circular recess by way of which the insertable tool can be fastened to an angle grinder spindle with a lock nut by nonpositive engagement in the circumferential direction and by positive engagement in the axial direction. Both insertable tools that have a reinforcement of sheet metal in the region of the recess and those without such a reinforcement are known.

SUMMARY OF THE INVENTION

The invention is based on an insertable tool with a rotationally driven disk-shaped hub, to which a grinding means is secured in the radially outer region.

It is proposed that the hub is embodied with a flexural strength that varies in the radial direction. An advantageous transition between the grinding means and the hub can be achieved, and overall, a harmonious bending line can be attained. An advantageous hold between the grinding means and the hub can be achieved, and detachment on fastening the insertable tool, for instance to a spindle of an angle grinder, and during work can be reliably avoided.

A flexural strength or bending line can be purposefully adapted to a desired course in a structurally simple way by means of the design of recesses made in the radially outer region of the hub. The flexural strength of the hub can be purposefully weakened in individual regions. The recesses can have various shapes that appear useful to one skilled in the art. The recesses may be embodied as slots of constant width and/or slots with a width that decreases radially inward either continuously or in stages, as a result of which the flexural strength decreases radially outward because the hub material decreases radially outward.

In a further feature of the invention, it is proposed that at least one recess has a greater width in the radially inner region than in the radially outer region, as a result of which an advantageously large fastening area can be furnished in the radially outer region, while in the adjacent radially inner region a kind of spring region can be achieved. The recesses are advantageously embodied as open radially outward, and as a result, segments that can be largely deflected independently of one another can advantageously be achieved. In principle, however, the recesses can also be embodied as closed radially outward.

Instead of recesses, other structural embodiments appearing useful to one skilled in the art are conceivable for achieving a certain bending line, such as embodiments with material thicknesses that increase or decrease radially outward, different numbers of layers of material, different materials with different rigidity and/or with reinforcing ribs in order to establish a desired bending line. Moreover, materials that radially outward are subjected to different material treatments are conceivable.

The hub is advantageously produced economically and in an environmentally friendly way from a sheet metal, in particular sheet steel. The grinding means, which is often recyclable only with difficulty, can advantageously be used up, while the hub can be recycled easily. In principle, however, any other hub materials are also conceivable, such as plastic, ceramic materials, and so forth.

The provisions for attaining the object of the invention can be employed especially advantageously in grinding means that form a cutting-off, grinding, roughing, and/or parting wheel. Especially the grinding means of a thin cutting-off wheel, compared to a sheet-metal hub without the aforementioned recesses, has very great flexibility. The adapted bending line of the sheet-metal hub means that detachment of the grinding means from axially exerted forces can be reliably avoided. In principle, however, these provisions of the invention can also be employed in insertable tools in which the grinding means is formed by a grinding paper or the like.

In another feature of the invention, it is proposed that the hub is covered at least partly on both sides by at least one layer of the grinding means, for instance a fabric layer that carries abrasive substances, or fiberglass mats, and so forth, as a result of which the connection between the hub and the grinding means can be improved. A positive engagement can be attained in both axial directions.

Moreover, the connection can be improved by providing that the grinding means and the hub are connected by positive engagement at least in the direction of rotation via connecting means. Strong driving moments can be reliably transmitted from the hub to the grinding means. Besides a positive engagement in the direction of rotation, a positive engagement in the axial direction is conceivable, for instance by means of angled and/or offset protrusions and so forth. The positive engagement can be realized in a structurally simple way, without additional components, by means of protrusions extending in the axial direction from the hub and forming the connecting means, which reach into or through the grinding means in the axial direction and can be formed onto the hub advantageously in a stamping process, for instance jointly with other recesses. Particularly with thin grinding means, an axial positive engagement can be accomplished by bending formed-on protrusions or grooved frames, which reach through the grinding means, over outward or inward in an economical way in the course of pressing the grinding means.

A connection between the hub and the grinding means can be further improved by providing that in a production process of the grinding means, the grinding means and the hub are jointly subjected to at least one heating process, and/or that the grinding means is joined to the hub not only via a nonpositive and/or positive connection but also via a material-engagement connection, such as an adhesive connection in particular. The material-engagement connection can be established either after or during the production process of the grinding means. If the production process of the grinding means is utilized for connecting the hub and the grinding means, then additional work steps can be saved, and overall, a more-rational production process of the insertable tool can be achieved. In particular, a gluing operation can be easily integrated into the grinding means production process, but still other material-engagement connections are also conceivable, such as soldered and/or welded connections, and so forth.

The provisions according to the invention can be used in insertable tools that are fastened to a spindle via a lock nut and can also be used especially advantageously in hubs that have not only a central recess but also recesses for fastening via a fast-action clamping system. Upon mounting on a spindle, mounting forces that occur can advantageously be absorbed in the axial direction via a harmonious bending line.

BRIEF DESCRIPTION OF THE DRAWINGS

Further advantages will become apparent from the ensuing drawing description. In the drawing, exemplary embodiments of the invention are shown. The drawing, description and claims include numerous characteristics in combination. One skilled in the art will expediently consider the characteristics individually as well and put them together to make useful further combinations.

Shown are.

DETAILED DESCRIPTION OF THE PREFERRED EMBODIMENTS

Figure 1:
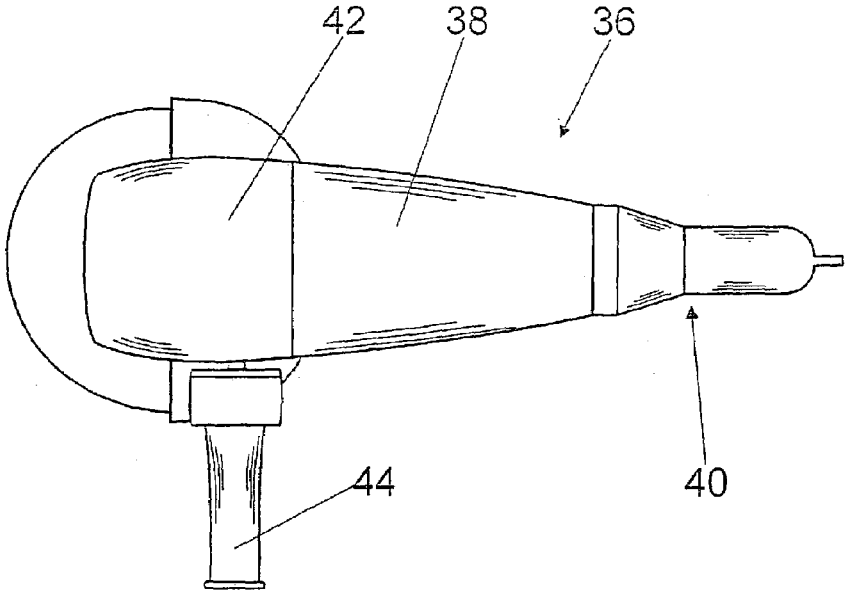
FIG. 1, an angle grinder shown schematically from above.

FIG. 1 shows an angle grinder 36 from above, with an electric motor, not shown in detail, supported in a housing 38. The angle grinder 36 can be guided via a first grip 40, which is integrated with the housing 38 on the side remote from an insertable tool and which extends longitudinally, and via a second grip 44, secured to a gearbox 42 in the region of the insertable tool and extending transversely to the longitudinal direction.

Figure 2:
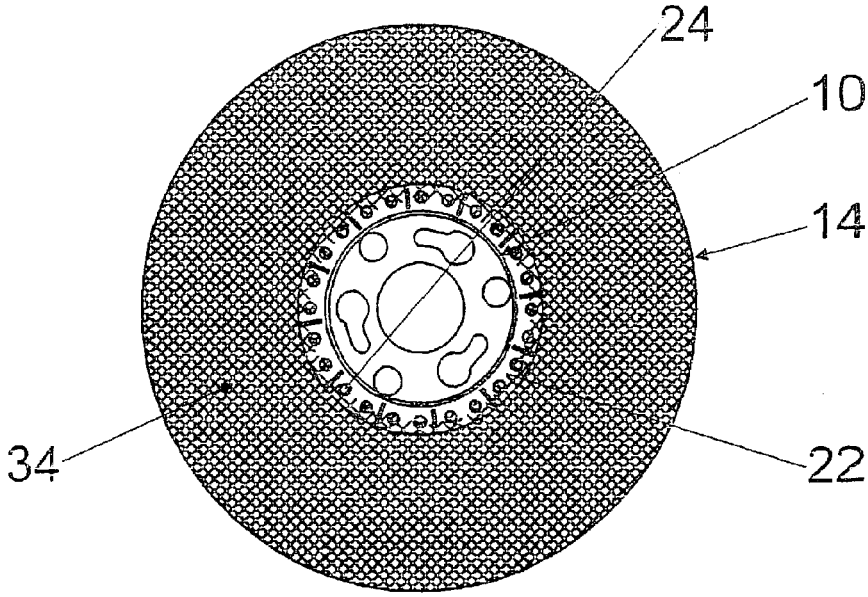
FIG. 2, an insertable tool of the invention.

FIG. 2 shows the insertable tool of FIG. 1 by itself. The insertable tool has a rotationally driven disk-shaped hub 10 of sheet steel, to which, in the radially outer region, a grinding means 14 forming a grinding wheel is fastened. The grinding means 14 is essentially composed of fiberglass mats, grinding means and binder that are pressed together to make a solid disk; the binder has been hardened in a heating process.

According to the invention, the hub 10 is embodied with a flexural strength that varies in the radial direction; in its radially outer region, to adapt the flexural strength, the hub 10 is purposefully weakened by slotlike recesses 16. The recesses 16 are embodied as open radially outward, thus advantageously creating segments that can be deflected largely independently of one another. The recesses 16 have a constant width and protrude radially inward to just before a region in which recesses 30, 32 are made, for fastening the insertable tool to an angle grinder spindle via a fast-action clamping system. In the middle region of the hub 10, a circular recess 28 is made, for centering the insertable tool.

The hub is covered on both sides by at least one layer 22, 24 of the grinding means 14; on one side 48, oriented toward the angle grinder 36, the grinding means 14 is disposed with essentially its full thickness in an annular indentation, so that the hub 10 and the grinding means 14 advantageously come to an end, in the direction of the angle grinder 36, in the same plane. In the event that the grinding means 14 should come loose from the hub 10 during operation, however, it is still secured in captive fashion by the hub 10 (FIGS. 2 and 4) in the direction remote from the angle grinder 36. On a side 34 remote from the angle grinder 36, a layer 22 of the grinding means 14, formed by a fiberglass mat, covers the hub 10 radially inward.

Figure 4:
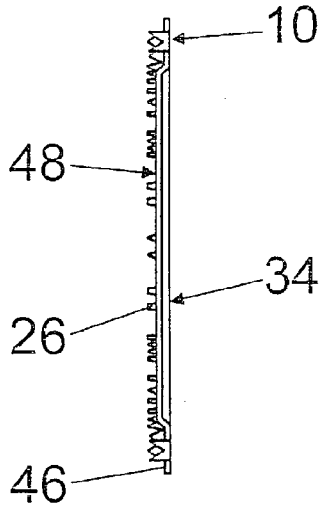
FIG. 4, the hub of FIG. 3 in a side view.

The grinding means 14 and the hub 10 are connected by positive engagement in the direction of rotation via connecting means 26 (FIG. 4). The connecting means 26 are formed by protrusions formed onto the hub 10 and extending in the axial direction, which axially reach into or through the grinding means 14. The protrusions forming the connecting means 26 are formed on together with the recesses 16, 28, 30, 32 in a joint stamping process. Besides a positive engagement in the circumferential direction, an axial positive engagement, particularly in the case of this grinding means, can be accomplished by bending formed-on protrusions or grooved frames, which reach through the grinding means, over outward or inward in an economical way during the pressing of the grinding means.

In the production process of the grinding means 14, the hub 10 and the grinding means 14 are subjected to a joint heating process, in which a material-engagement connection between the grinding means 14 and the hub 10, specifically an adhesive connection, is hardened.

Figure 3:
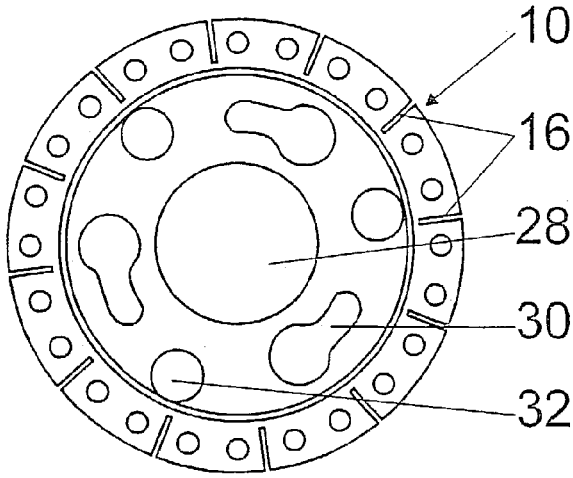
FIG. 3, an enlarged view of a hub without the grinding means, from above.
Figure 5:
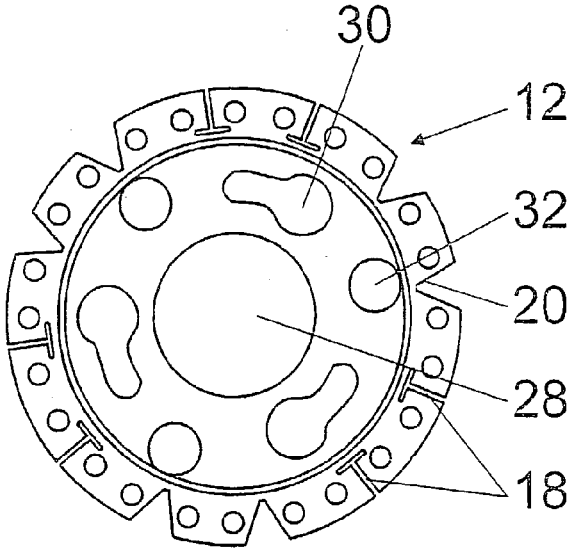
FIG. 5, an alternative to FIG. 3.

In FIG. 5, an alternative hub 12 is shown. Components that remain essentially the same are fundamentally identified by the same reference numerals. Moreover, for characteristics and functions that remain the same, reference may be made to the description of the exemplary embodiment of FIGS. 2 and 3.

The hub 12 has recesses 18, 20, which are embodied as open radially outward and which have different widths in the radial direction. The recesses 18 are embodied in the shape of a T and in their radially inner region they have a greater width than in the radially outer region, while conversely the recesses 20 are embodied as V-shaped and have a decreasing width radially inward. In FIG. 4, the recesses 18 and 20 are combined with one another, but it is also conceivable to provide solely the recesses 18 or the recesses 20 on a given hub.

LIST OF REFERENCE NUMERALS

| | |
|---|---|
| 10 | Hub |
| 12 | Hub |
| 14 | Grinding means |
| 16 | Recess |
| 18 | Recess |
| 20 | Recess |
| 22 | Layer |
| 24 | Layer |
| 26 | Connecting means |
| 28 | Recess |
| 30 | Recess |
| 32 | Recess |
| 34 | Side |
| 36 | Angle grinder |
| 38 | Housing |
| 40 | Grip |
| 42 | Gearbox |
| 44 | Grip |
| 46 | Indentation |
| 48 | Side |

The invention claimed is:

1. An insertable tool, comprising: a rotationally driven disk-shaped hub (10, 12), wherein a grinding means (14) is secured on one side in a radially outer region of said rotationally driven disc-shaped hub (10, 12), wherein the hub (10, 12) has means (16, 18, 20) for adapting a flexural strength of the hub (10, 12) to a flexural strength of the grinding means (14), wherein the hub (10, 12) is formed of sheet metal, and wherein in the radially outer region of the hub (10, 12) recesses (16, 18, 20) are made, for adapting the flexural strength, at least some of said recesses (16, 18, 20) being open radially outwardly and being void of any material of the grinding means (14) within a width of said recesses (16, 18, 20), said recesses being covered in an axial direction bit at least one layer (22, 24) of the grinding means (14).

2. The insertable tool of claim 1, wherein at least one recess (20) has a smaller width in a radially inner region than in the radially outer region.

3. The insertable tool of claim 1, wherein at least one recess (18) has a greater width in a radially inner region than in the radially outer region.

4. The insertable tool of claim 1, wherein the grinding means (14) forms a wheel selected from the group consisting of a cutting-off wheel, a grinding wheel, a roughing wheel, and a parting wheel.

5. The insertable tool of claim 1, wherein the hub (10, 12) is covered at least partly on both sides by at least one layer (22, 24) of the grinding means (14).

6. The insertable tool of claim 1, wherein the grinding means (14) and the hub (10, 12) are connected by positive engagement at least in the direction of rotation via connecting means (26).

7. The insertable tool of claim 6, wherein protrusions forming the connecting means (26) and extending in the axial direction are formed onto the hub (10, 12) and reach into the grinding means (14).

8. The insertable tool of claim 1, wherein the grinding means and the hub are connected by positive engagement in the axial direction via at least one connecting means.

9. The insertable tool of claim 1, wherein in a production process of the grinding means (14), the grinding means (14) and the hub (10, 12) are jointly subjected to at least one heating process.

10. The insertable tool of claim 1, wherein the grinding means (14) and the hub (10, 12) are connected via a material-engagement connection.

11. The insertable tool of claim 10, wherein the grinding means (14) and the hub (10, 12) are glued.

12. The insertable tool of claim 1, wherein the hub (10, 12) has not only a central recess (28) but also recesses (30, 32) for fastening via a fast-action clamping system.

13. The insertable tool of claim 1, wherein said recesses include first recesses having a first shape and second recesses having a second shape which is different from the first shape.

14. The insertable tool of claim 13, wherein the first recesses have a smaller width in a radially inner region than in the radially outer region, while the second recesses have a greater width in the radially inner region than in the radially outer region.

* * * * *